US009368883B2

(12) United States Patent
Chiang et al.

(10) Patent No.: US 9,368,883 B2
(45) Date of Patent: Jun. 14, 2016

(54) MULTI-CABLE CONNECTOR

(71) Applicant: BO-JIANG TECHNOLOGY CO., LTD., Tainan (TW)

(72) Inventors: Chang-Hui Chiang, Tainan (TW); Pi-Chien Yeh, Kaohsiung (TW); Chih-Yung Chen, Tainan (TW)

(73) Assignee: BO-JIANG TECHNOLOGY CO., LTD., Tainan (TW)

( * ) Notice: Subject to any disclaimer, the term of this patent is extended or adjusted under 35 U.S.C. 154(b) by 0 days.

(21) Appl. No.: 14/610,526

(22) Filed: Jan. 30, 2015

(65) Prior Publication Data

US 2015/0380840 A1 Dec. 31, 2015

(30) Foreign Application Priority Data

Jun. 30, 2014 (TW) ..... 103211594 U

(51) Int. Cl.
*H01R 9/05* (2006.01)

(52) U.S. Cl.
CPC ..... *H01R 9/0506* (2013.01); *H01R 9/0515* (2013.01); *H01R 9/0524* (2013.01)

(58) Field of Classification Search
CPC .... H01R 13/58; H01R 23/661; H01R 9/0506; H01R 9/0515; H01R 9/0524; H01R 13/502; H01R 13/516; H01R 13/5804; H01R 13/5825; H01R 13/5845; H01R 24/38; Y10S 439/942
USPC ..... 439/579, 449, 452, 457, 460, 465, 942
See application file for complete search history.

(56) References Cited

U.S. PATENT DOCUMENTS

| | | | | | |
|---|---|---|---|---|---|
| 4,900,258 | A * | 2/1990 | Hnatuck | H01R 23/688 | 439/502 |
| 5,643,016 | A * | 7/1997 | Huss, Jr. | H01R 13/434 | 439/689 |
| 6,293,829 | B1 * | 9/2001 | Qiao | H01R 9/22 | 439/404 |
| 6,482,028 | B2 * | 11/2002 | Kumamoto | H01R 13/5808 | 439/498 |
| 6,726,503 | B2 * | 4/2004 | Waddell | H01R 13/65807 | 439/465 |
| 6,783,100 | B1 * | 8/2004 | Cinq-Mars | F16L 1/265 | 248/49 |
| 7,059,892 | B1 * | 6/2006 | Trout | H01R 13/5812 | 439/460 |
| 7,503,776 | B1 * | 3/2009 | Pavlovic | H01R 4/46 | 439/455 |
| 7,722,382 | B2 * | 5/2010 | Landis | H01R 4/26 | 439/393 |
| 8,002,574 | B1 * | 8/2011 | Yi | H01R 13/582 | 439/455 |
| 8,342,459 | B2 * | 1/2013 | Garrison | H01R 12/63 | 248/316.7 |
| 2011/0312225 | A1 * | 12/2011 | Tai | H01R 13/516 | 439/660 |

* cited by examiner

*Primary Examiner* — Neil Abrams
*Assistant Examiner* — Travis Chambers
(74) *Attorney, Agent, or Firm* — Li & Cai Intellectual Property (USA) Office

(57) ABSTRACT

A multi-cable connector includes a main body, a plurality of cable assemblies, and a fixing unit. The cable assemblies are inserted into the main body. Each cable assembly has a connecting head and a cable. The fixing unit is installed on the main body. The fixing unit has a plurality of notches for providing the cables to respectively couple there-through. The fixing unit abuts against the connecting heads for holding the connecting heads between the main body and the fixing unit.

8 Claims, 6 Drawing Sheets

MULTI-CABLE CONNECTOR

BACKGROUND OF THE INVENTION

1. Field of the Invention

The instant invention relates to a connector; in particular, to a multi-cable connector having good fixing effect for cable assembly.

2. Description of Related Art

In the flourishing communication environment, transmission technology has improved based on the user's demand, and the transmission of radio frequency (RF) or microwave needs higher transmission quality. Transmitting the electromagnetic information by cable has become an increasingly popular form, and coaxial cable is commonly used to transmit the electromagnetic information. Many communication devices are designed to be connected to the coaxial cable. Accordingly, a number of coaxial cable connectors are typically used to connect two coaxial cables and/or two communication devices. The coaxial cable connector provides an accurate, consistent and reliable connection, so that coaxial cables may be suitably exchanged. Therefore, it is important to make sure that the cable connectors are properly connected.

Taking a multi-coaxial cable connector connected to a circuit board for example, the multi-coaxial cable connector has a plurality of coaxial cables simultaneously disposed on the connector body. Specifically, the manner in which the coaxial cables are arranged on the connector body is primarily by forming a plurality of channels in the connector body for receiving the coaxial cables. The coaxial cables are respectively coupled through the channels, thereby retaining the coaxial cables in the connector body.

However, in the above-described configuration of the multi-coaxial cable connector, the means of retaining the coaxial cables in the connector body by forming the channels is usually provided with an insufficient interference force between each coaxial cable and the corresponding channel, so that the means usually causes the coaxial cables to be loosened or fall off the circuit board by a slight external force, which then results in malfunction of the corresponding electronic product.

Thus, how to maintain the construction of the multi-coaxial cable connector with good connecting performance is a topic of concern in the connector field.

SUMMARY OF THE INVENTION

The instant disclosure provides a multi-cable connector having good fixing effect for preventing the cable assembly from loosening or dropping off.

The instant disclosure provides a multi-cable connector, comprising: a main body; a plurality of cable assemblies inserted into the main body, wherein each cable assembly has a connecting head and a cable; and a fixing unit received in the main body and having a plurality of notches, wherein the cables respectively couple through the notches, the fixing unit abuts against the connecting heads for holding the connecting heads between the main body and the fixing unit.

In summary, the multi-cable connector of the instant disclosure is provided with the fixing unit abutting against the connecting heads of the cable assemblies to firmly fix the cable assemblies on the main body for preventing the cable assemblies from loosening or dropping off the main body, thereby maintaining good connection between the cable assemblies and a circuit board.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

References are hereunder made to the detailed descriptions and appended drawings in connection with the instant invention. However, the appended drawings are merely shown for exemplary purposes, rather than being used to restrict the scope of the instant invention.

Moreover, the following embodiments may use the words "first", "second", and "third" for describing some elements, but the elements are not limited by the words. That is to say, the "first", "second", and "third" are used for distinguishing from the elements. Thus, the instant disclosure can teach the first element regarded as the second element. The word "or" in the following embodiments can be explained as one of the terms or the combination of the terms.

Figure 1:
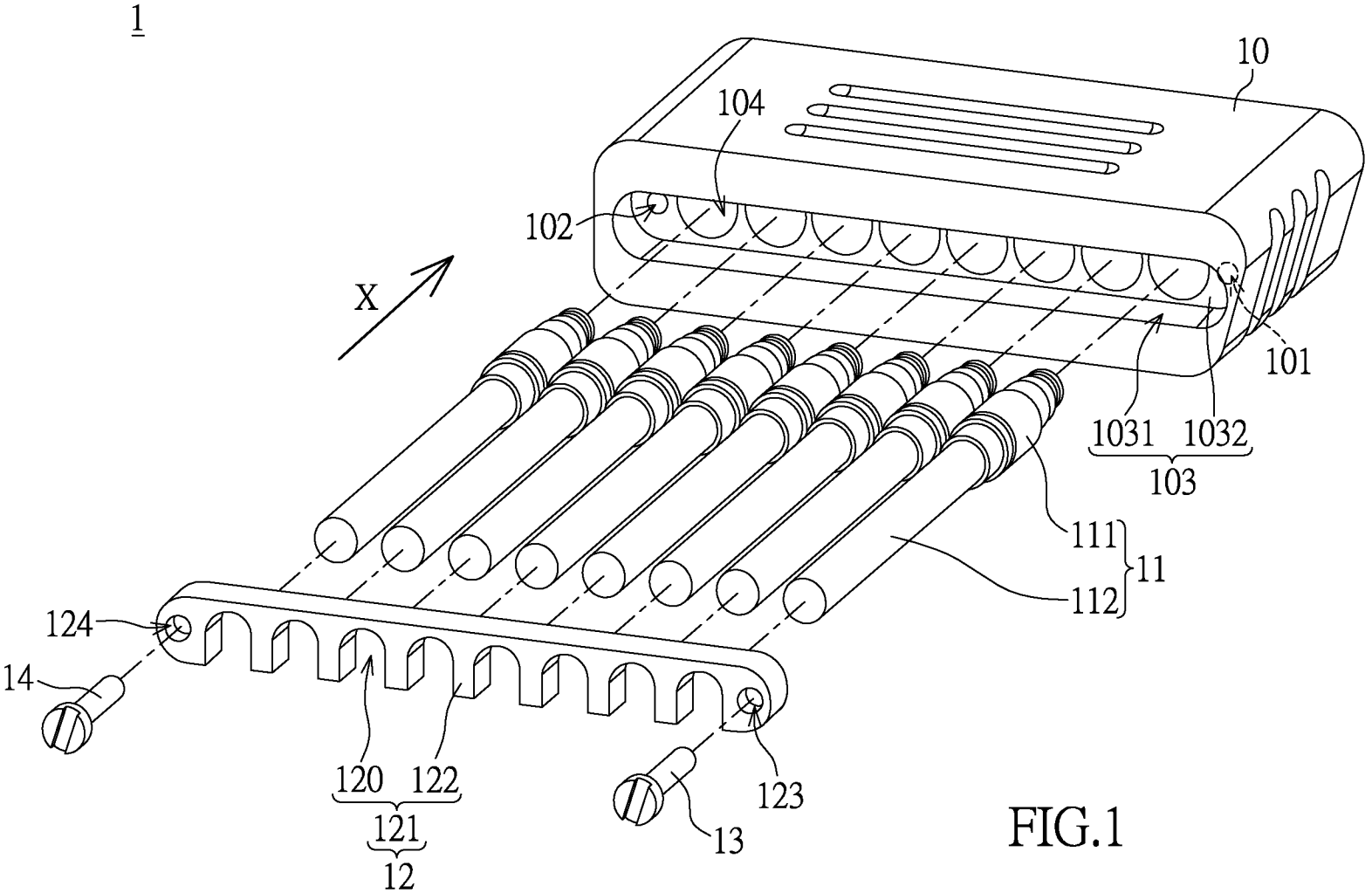
FIG. 1 is an exploded view of a multi-cable connector according to one embodiment of the instant disclosure.
Figure 2:
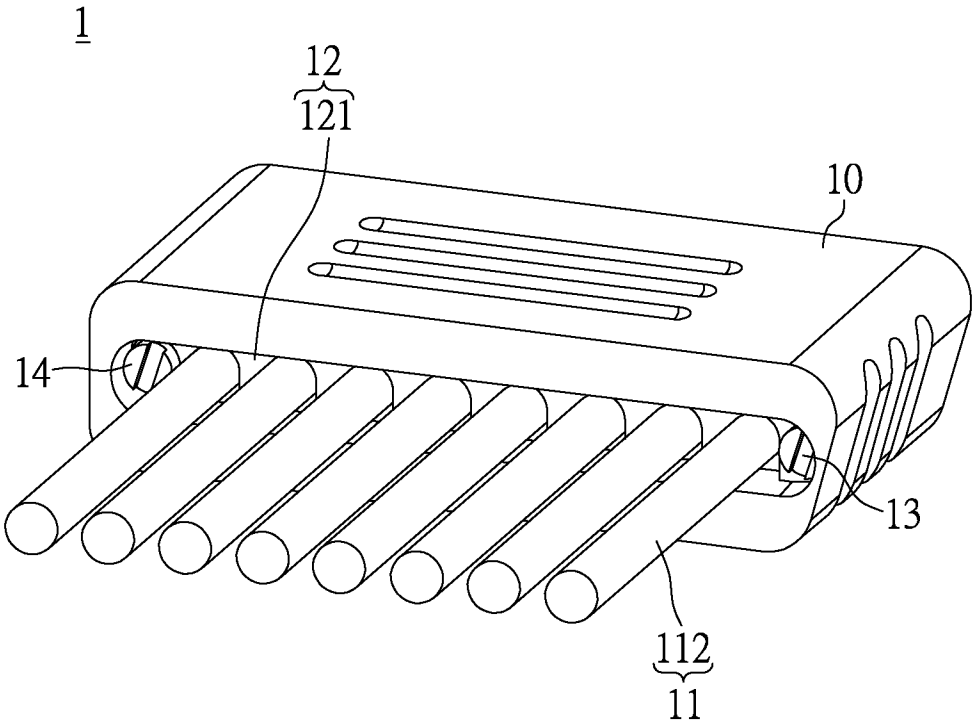
FIG. 2 is a perspective view showing the multi-cable connector.

Please refer to FIGS. 1 and 2, which respectively show an exploded view and a combined view of a multi-cable connector 1 according to an embodiment of the instant disclosure. As shown in FIG. 1, the multi-cable connector 1 of the instant embodiment includes a main body 10, a plurality of cable assemblies 11 inserted into the main body 10, and a fixing unit 12 received in the main body 10. Each cable assembly 11 has a connecting head 111 and a cable 112 connecting to the connecting head 111 thereof, and the external diameter of the connecting head 111 is greater than the external diameter of the cable 112. The fixing unit 12 has a plurality of notches 120, and the cables 112 respectively couple through the notches 120. The fixing unit 12 abuts against the connecting heads 111 for holding the connecting heads 111 between the main body 10 and the fixing unit 12. As shown in FIGS. 1 and 2, after combining the elements of the multi-cable connector 1, the cable assemblies 11 are firmly fixed onto the main body 10 by the fixing unit 12 abutting against the connecting heads 111, thereby preventing the cable assemblies 11 from loosening or dropping off the main body 10.

The following description further discloses the detailed construction of the multi-cable connector 1 provided by the instant embodiment.

As shown in FIG. 1, the fixing unit 12 of the instant embodiment includes a comb plate 121 having a plurality of teeth 122 arranged in one row. Each notch 120 is arranged between two adjacent teeth 122, that is to say, each notch 120 is defined by two adjacent teeth 122. Specifically, the teeth 122 are in an equidistant arrangement, and the contours of the teeth 122 (or the shapes of the notches 120) are substantially the same, but the teeth 122 are not limited thereto. The contour of each tooth 122 (or the shape of each notch 120) can be adjusted according to the external diameter of the cable 112 of each cable assembly 11.

Incidentally, the shape of each notch 120 is slightly larger than the external diameter of the corresponding cable 112, such that when the cables 112 respectively pass through the notches 120, the cables 112 are retained in the notches 120 for limiting the position of each cable 112. The instant embodiment takes the shape of each notch 120 slightly larger than the external diameter of the corresponding cable 112 for example, but the instant disclosure is not limited thereto. For example, in a not-shown embodiment, the shape of each notch 120 can be slightly smaller than the external diameter of the corresponding cable 112, such that when the cables 112 respectively pass through the notches 120, the cables 112 are compressed by the teeth 122 for fixing the cables 112.

Figure 3:
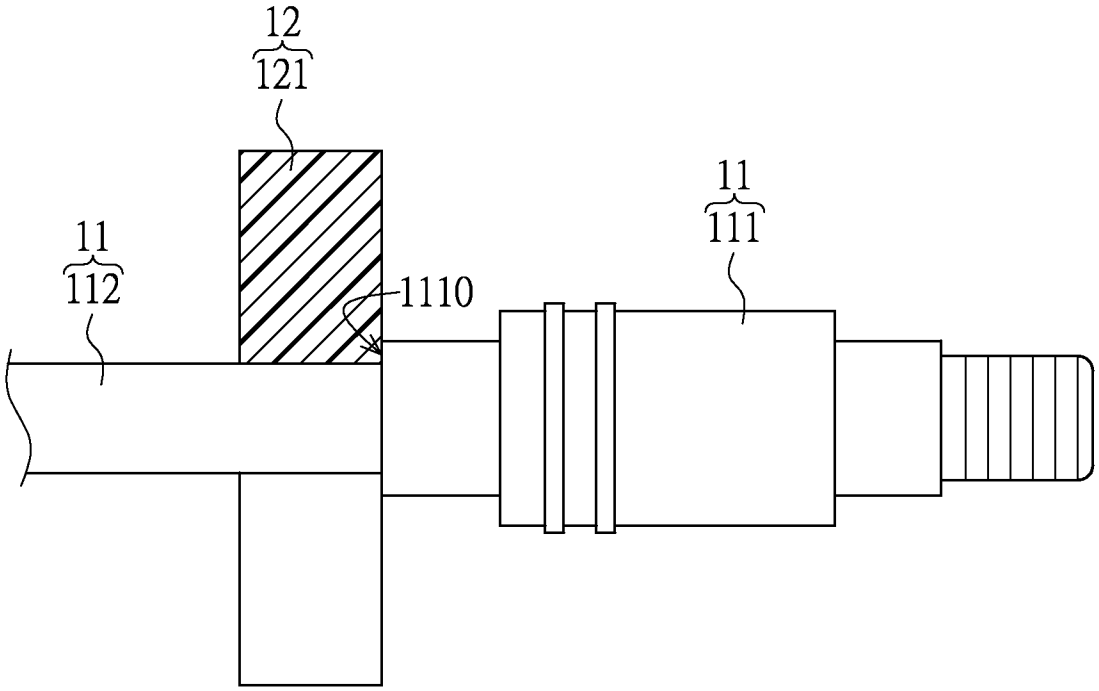
FIG. 3 is a perspective view showing the connection between the cable assembly and the fixing unit.

Please refer to FIG. 3 which shows a perspective view of the connection between the cable assembly 11 and the fixing unit 12. As shown in FIG. 3, the connecting head 111 of each cable assembly 11 has an abutting surface 1110 facing the fixing unit 12. When the fixing unit 12 is installed on the main body 10, the comb plate 121 abuts against the abutting surface 1110 of each connecting head 110, such that the cable assemblies 11 are fixed onto the main body 10 by the comb plate 121. Moreover, in order to clearly show the connection between the comb plate 121 and the abutting surface 1110 of each connecting head 110, FIG. 3 only shows one cable assembly 11 and the corresponding portion of the comb plate 121.

As shown in FIG. 1, the multi-cable connector 1 further includes at least two fixing components 13, 14. The main body 10 has at least two holes 101, 102. The comb plate 121 has at least two calibrating holes 123, 124 arranged at two opposite sides of the teeth 122, that is to say, the teeth 122 are arranged between the calibrating holes 123, 124. The calibrating holes 123, 124 respectively align with the holes 101, 102 of the main body 10. The locking components 13, 14 couple through the calibrating holes 123, 124 of the comb plate 121 and the holes 101, 102 of the main body 10 to fix onto the main body 10, thereby fixing the comb plate 121 on the main body 10. Specifically, the means for fixing the comb plate 121 on the main body 10 is disclosed as follows: the locking components 13, 14 sequentially couple through the calibrating holes 123, 124 of the comb plate 121 and the holes 101, 102 of the main body 10 along a longitudinal direction X of each cable assembly 11 to fix onto the main body 10. The locking components 13, 14 can be the screws, but the instant disclosure is not limited thereto.

As shown in FIG. 1, the main body 10 of the instant embodiment further includes an accommodating trough 103 and a plurality of channels 104 arranged in one row perpendicular to the longitudinal direction X of each cable assembly 11. The accommodating trough 103 has an opening 1031 and a bottom wall 1032 corresponding to the opening 1031. When the fixing unit 12 is installed on the main body 10, the fixing unit 12 is received in the accommodating trough 103 by passing through the opening 1031. The channels 104 are concavely formed on the bottom wall 1032, and the channels 104 communicate with the accommodating trough 103 and are respectively aligned with the notches 120 of the fixing unit 12. Therefore, when the cable assemblies 11 are installed on the main body 10, the connecting heads 111 are respectively received in the channels 104. Moreover, the internal diameter of each channel 104 is smaller than the largest external diameter of the corresponding connecting head 111, so that each connecting head 111 is engaged in the corresponding channel 104.

The holes 101, 102 are also concavely formed on the bottom wall 1032. In the instant embodiment, the channels 104 are arranged between the holes 101, 102, that is to say, the holes 101, 102 are arranged at two opposite sides of the channels 104, but the instant embodiment is not limited thereto. The arrangement of the holes 101, 102 can be changed according to the designer's request.

Incidentally, the instant embodiment takes the fixing unit 12 fixed onto the main body 10 by the fixing components 13, 14 for example, but the instant disclosure is not limited thereto. For example, in a not-shown embodiment, the fixing unit 12 can be fixed onto the main body 10 by an interference fit means or a transition fit means. Specifically, about the interference fit means, the contour of the fixing unit 12 is slightly larger than the opening 1031 of the accommodating trough 103, such that the fixing unit 12 can be inserted into the accommodating trough 103 by pressing, and then the fixing unit 12 is fixed in the main body 10 by interfering with the accommodating trough 103.

Figure 4:
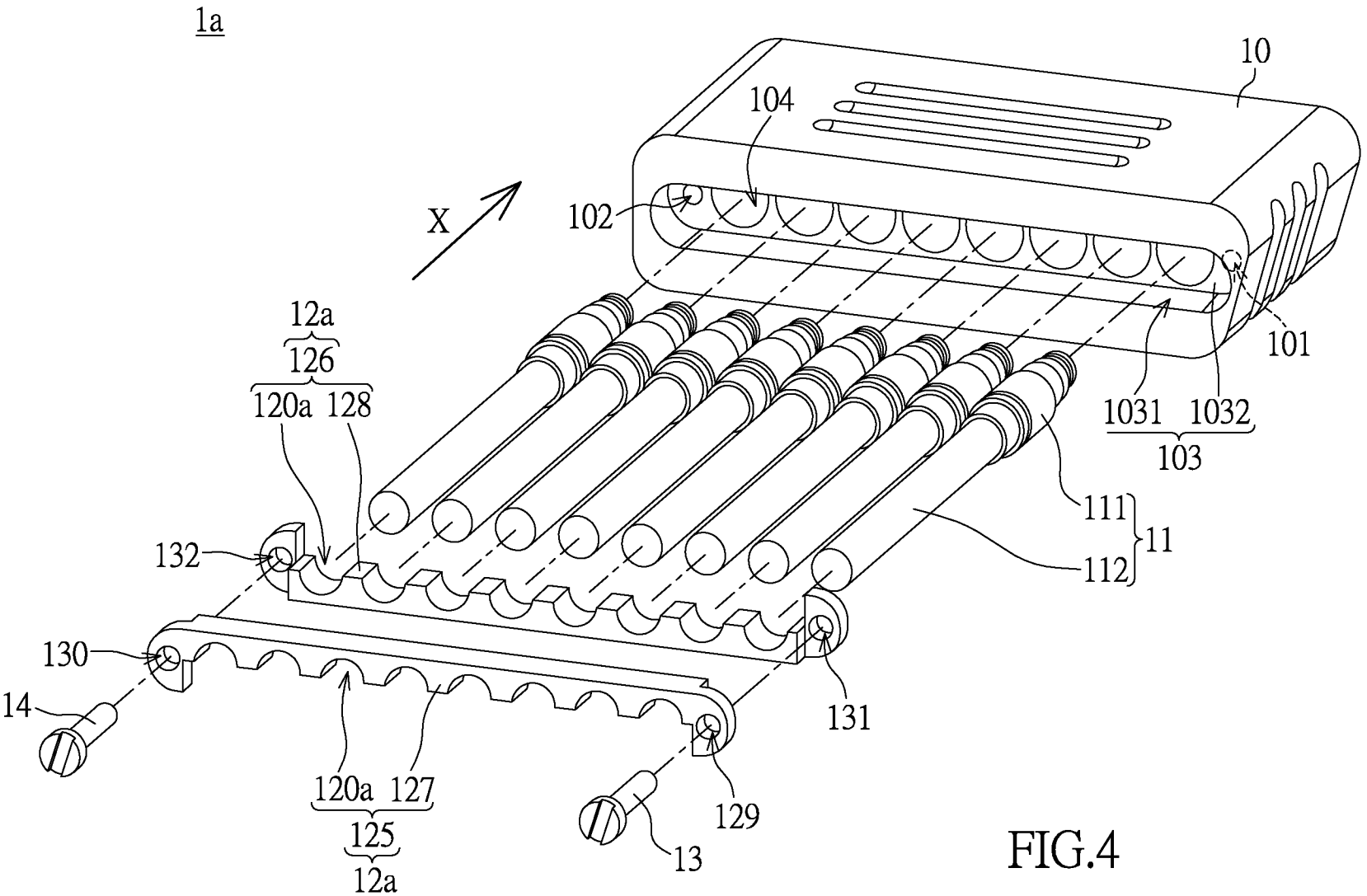
FIG. 4 is an exploded view of the multi-cable connector according to another embodiment of the instant disclosure.
Figure 5:
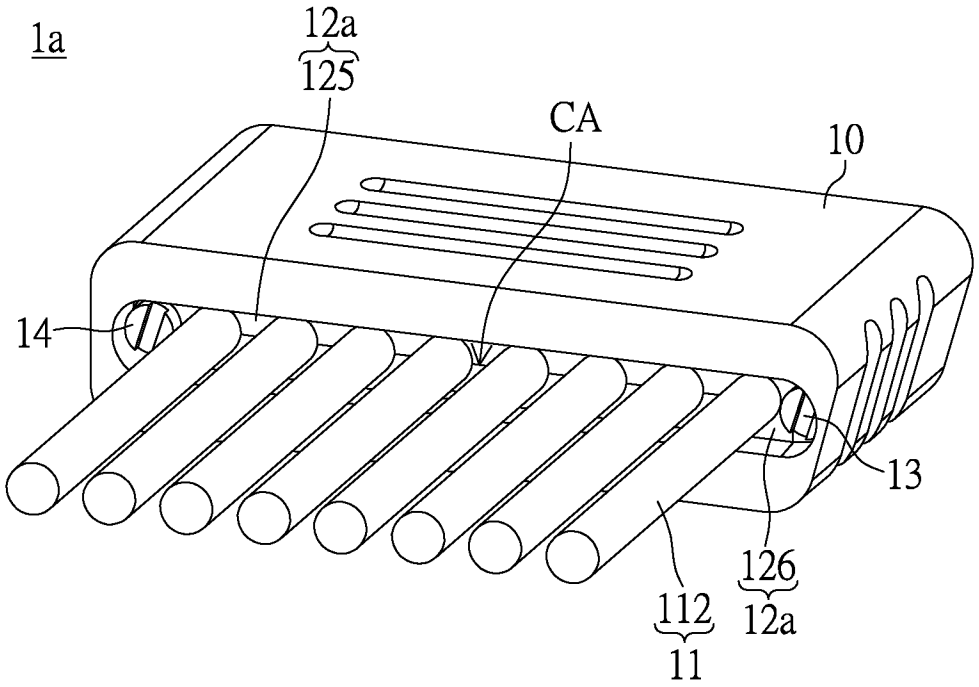
FIG. 5 is a perspective view showing the multi-cable connector.

Please refer to FIGS. 4 and 5, which respectively show an exploded view and a combined view of the multi-cable connector 1*a* according to another embodiment of the instant disclosure. As shown in FIG. 4, the multi-cable connector 1*a* of the instant embodiment is approximately similar to the multi-cable connector 1 as shown in FIGS. 1 and 2, and the difference between the two embodiments is disclosed as follows. The fixing unit 12*a* of the instant embodiment includes a first comb plate 125 and a second comb plate 126. The first comb plate 125 has a plurality of first teeth 127, and the second comb plate 126 has plurality of second teeth 128. The second comb plate 126 is detachably connected to the first comb plate 125, the second teeth 128 are respectively corresponding to the first teeth 127, and an end of each second tooth 128 is connected to an end of the corresponding first tooth 127 for defining a connecting interface CA. The fixing unit 12*a* has a plurality of notches 120*a* for providing the cables 112 to pass there-through. Each notch 120*a* is defined by two adjacent first teeth 127 and the corresponding second teeth 128.

Specifically, part of each notch 120*a* (i.e., the upper part of each notch 120*a* as shown in FIG. 4) is defined by two adjacent first teeth 127, and another part of each notch 120*a* (i.e., the lower part of each notch 120*a* as shown in FIG. 4) is defined by two adjacent second teeth 128. When the first comb plate 125 is connected to the second comb plate 126, the upper part and the corresponding lower part of each notch 120*a* are combined to be one entire notch 120*a*. When the cables 112 respectively pass through the notches 120*a*, part of each cable 112 is limited by the upper part of the corresponding notch 120*a*, and another part of each cable 112 is limited by the lower part of the corresponding notch 120*a*.

Figure 6:
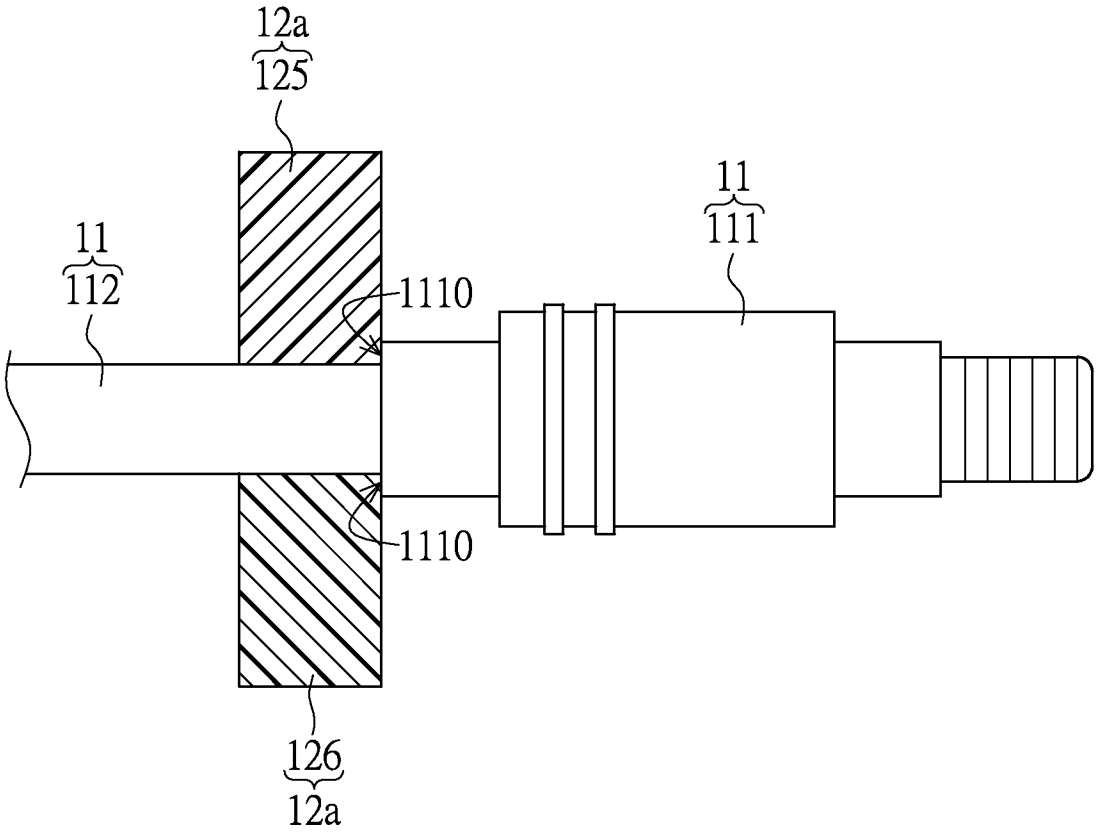
FIG. 6 is a perspective view showing the connection between the cable assembly and the fixing unit.

Please refer to FIG. 6 which shows a perspective view of the connection between the cable assembly 11 and the fixing unit 12*a*. As shown in FIG. 6, the connecting head 111 of each cable assembly 11 has an abutting surface 1110 facing the fixing unit 12*a*. When the fixing unit 12*a* is installed on the main body 10, the first and second comb plates 125, 126 abut against the abutting surface 1110 of each connecting head 110, such that the cable assemblies 11 are fixed onto the main body 10 by the first and second comb plates 125, 126. Moreover, in order to clearly show the connection between the first and second comb plates 125, 126 and the abutting surface 1110 of each connecting head 110, FIG. 6 only shows one cable assembly 11 and the corresponding portions of the first and second comb plates 125, 126.

As shown in FIG. 4, the first comb plate 125 has at least two first calibrating holes 129, 130 arranged at two opposite sides of the first teeth 127, that is to say, the first teeth 127 are arranged between the first calibrating holes 129, 130. The first calibrating holes 129, 130 respectively align with the holes 101, 102 of the main body 10. The second comb plate 126 has at least two second calibrating holes 131, 132 arranged at two opposite sides of the second teeth 128, that is to say, the second teeth 128 are arranged between the second calibrating holes 131, 132. The second calibrating holes 131, 132 respectively align with the first calibrating holes 129, 130 of the first comb plate 125. The locking components 13, 14 couple through the first and second calibrating holes 129~132 of the first and second comb plates 125, 126 and the holes 101, 102 of the main body 10 to fix onto the main body 10, thereby fixing the first and second comb plates 125, 126 onto the main body 10. Specifically, the means for fixing the first and second comb plates 125, 126 on the main body 10 is disclosed as follows: the locking components 13, 14 sequentially couple through the first and second calibrating holes 129~132 of the first and second comb plates 125, 126 and the holes 101, 102 of the main body 10 along the longitudinal direction X of each cable assembly 11 to fix onto the main body 10.

In a not-shown embodiment, the fixing unit 12 can be fixed onto the main body 10 by an interference fit means or a transition fit means, that is to say, the fixing unit 12 of the instant disclosure is not limited to the fixing components 13, 14.

Moreover, part of the elements of the multi-cable connector 1*a* of the instant embodiment are similar to the multi-cable connector 1 as shown in FIGS. 1 and 2, thus the similar elements of the multi-cable connector 1*a* are not disclosed in the instant embodiment.

In summary, the multi-cable connector of the instant disclosure is provided with the fixing unit abutting against the connecting heads of the cable assemblies to firmly fix the cable assemblies on the main body for preventing the cable assemblies from loosening or dropping off the main body, thereby maintaining good connection between the cable assemblies and a circuit board.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. A multi-cable connector, comprising:

a main body having at least two holes;

a plurality of cable assemblies inserted into the main body, wherein each cable assembly has a connecting head and a cable;

a fixing unit received in the main body and having a plurality of notches, wherein the cables respectively couple through the notches, the fixing unit abuts against the connecting heads for holding the connecting heads between the main body and the fixing unit, wherein the fixing unit includes a comb plate having a plurality of teeth, each notch is arranged between two adjacent teeth, the comb plate has at least two calibrating holes arranged at two opposite sides of the teeth, the calibrating holes respectively align with the holes of the main body; and at least two locking components coupling through the calibrating holes of the comb plate and the holes of the main body for fixing the comb plate on the main body.

2. The multi-cable connector as claimed in claim 1, wherein the locking components sequentially couple through the calibrating holes of the comb plate and the holes of the main body along a longitudinal direction of each cable assembly to fix onto the main body.

3. The multi-cable connector as claimed in claim 1, wherein the connecting head of each cable assembly has an abutting surface facing the fixing unit, and each connecting head abuts against the fixing unit by the abutting surface thereof.

4. The multi-cable connector as claimed in claim 1, wherein the main body comprises:

an accommodating trough having an opening and a bottom wall corresponding to the opening, wherein the fixing unit is received in the accommodating trough by passing through the opening; and a plurality of channels concavely formed on the bottom wall, wherein the channels are communicated with the accommodating trough and respectively align with the notches of the fixing unit, and the connecting heads are respectively received in the channels.

5. The multi-cable connector as claimed in claim 1, wherein the fixing unit is fixed onto the main body by interference fit means or transition fit means.

6. A multi-cable connector, comprising:

a main body having at least two holes;

a plurality of cable assemblies inserted into the main body, wherein each cable assembly has a connecting head and a cable;

a fixing unit received in the main body and having a plurality of notches, wherein the cables respectively couple through the notches, the fixing unit abuts against the connecting heads for holding the connecting heads between the main body and the fixing unit, wherein the fixing unit further comprises:

a first comb plate having a plurality of first teeth, wherein the first comb plate has at least two first calibrating holes arranged at two opposite sides of the first teeth, the first calibrating holes respectively align with the holes of the main body; and a second comb plate having a plurality of second teeth, wherein the second comb plate has at least two second calibrating holes arranged at two opposite sides of the second teeth, the second calibrating holes respectively align with the first calibrating holes, wherein the second comb plate is detachably connected to the first comb plate, the second teeth are respectively corresponding to the first teeth, an end of each second tooth is connected to an end of the corresponding first tooth, and each notch is defined by two adjacent first teeth and the corresponding second teeth; and at least two locking components coupling through the first and second calibrating holes of the first and second comb plates and the holes of the main body for fixing the first and second comb plates on the main body.

7. The multi-cable connector as claimed in claim 6, wherein the locking components sequentially couple through the first and second calibrating holes of the first and second comb plates and the holes of the main body along a longitudinal direction of each cable assembly to fix onto the main body.

8. A multi-cable connector, comprising:

a main body;

a plurality of cable assemblies inserted into the main body, wherein each cable assembly has a connecting head and a cable; and a fixing unit received in the main body and having a plurality of notches, wherein the cables respectively couple through the notches, the fixing unit abuts against the connecting heads for holding the connecting heads between the main body and the fixing unit, wherein the main body comprises:

an accommodating trough having an opening and a bottom wall corresponding to the opening, wherein the fixing unit is received in the accommodating trough by passing through the opening; and a plurality of channels concavely formed on the bottom wall, wherein the channels are communicated with the accommodating trough and respectively align with the notches of the fixing unit, and the connecting heads are respectively received in the channels.

* * * * *